United States Patent [19]

Gringer et al.

[11] Patent Number: 4,516,360

[45] Date of Patent: May 14, 1985

[54] MOLDED POLE-TYPE SANDPAPERING TOOL HAVING RESILIENT PAPER RETENTION MEANS

[75] Inventors: Donald Gringer, Bedford, N.Y.; Howard Soled, Teaneck, N.J.

[73] Assignee: Allway Tools, Inc., Bronx, N.Y.

[21] Appl. No.: 463,513

[22] Filed: Feb. 3, 1983

[51] Int. Cl.[3] ..... B24D 15/00

[52] U.S. Cl. ..... 51/384; 51/392; 15/231

[58] Field of Search ..... 51/358, 382, 383, 384, 51/385, 386, 388, 391, 392, 393; 15/144 R, 144 A, 231, 232, 233; 403/58, 74, 94

[56] References Cited

U.S. PATENT DOCUMENTS

| | | | |
|---|---|---|---|
| 2,201,645 | 5/1940 | Epner | 51/392 X |
| 2,334,039 | 11/1943 | Rueb | 403/58 X |
| 2,848,850 | 8/1958 | Metoff | 51/384 X |
| 2,954,649 | 10/1960 | Carroll et al. | 51/384 |
| 3,483,662 | 12/1969 | Ames | 51/392 |
| 3,850,533 | 11/1974 | Thielen | 403/58 X |

FOREIGN PATENT DOCUMENTS

| | | | |
|---|---|---|---|
| 2257393 | 8/1975 | France | 51/392 |
| 53919 | 8/1911 | Switzerland | 15/144 A |
| 318756 | 1/1957 | Switzerland | 15/144 A |

*Primary Examiner*—Robert P. Olszewski

*Attorney, Agent, or Firm*—Hubbell, Cohen, Stiefel & Gross

[57] ABSTRACT

A molded pole-type sandpapering tool (10) comprises a molded body member (12) having a flat backing surface (14) for the sandpaper (210) and a handle mounting surface (16) on the opposite side thereof which includes a two-piece resilient molded universal joint (18) to which a molded handle mount (22) is attached and two pairs of spaced apart pheripherally disposed molded contoured guide ramps (200*a*–200*b*, 200*c*–200*d*) adjacent opposite sides of the universal joint (18) and defining a pair of substantially orthogonally disposed slots (202*a*–202*f*) for the universally mounted handle (18) for enabling planar positioning thereof for applying optimum positive pressure to the abrasive surface. The contoured guide ramps comprise sloped contoured surfaces which positively guide the handle (20) on a contoured path between the orthogonal slots during universal movement of the handle (20) substantially in the plane of the abrasive surface (210) while maintaining optimum pressure. A pair of resilient wire spring clips (204, 206) are pivotally mounted to the guide ramps (200*a*–200*d*) for removably securing the ends of the sandpaper (210) to the body member (12) to hold the sandpaper (210) against the backing surface (14). The contoured guide ramps (200*a*–200*f*) have retention notches (212*a*–212*d*) therein for removably locking the spring clips (204, 206) in a sandpaper securing position against the handle mounting surface (16).

6 Claims, 7 Drawing Figures

10
12
14
16
18
18a
18b
20
22
24
108a
108b
108d
110
112
114
116
200a
200b
200c
200d
200b
202a
202b
202c
202d
202e
202f
204
206
210
212a
212b
212c
212d
218
7

MOLDED POLE-TYPE SANDPAPERING TOOL HAVING RESILIENT PAPER RETENTION MEANS

CROSS-REFERENCE TO RELATED APPLICATIONS

This application is related to my contemporaneously filed copending U.S. patent application entitled Molded Pole-type Sandpapering Tool, naming Donald Gringer, one of the joint inventors herein, as sole inventor thereof.

TECHNICAL FIELD

The present invention relates to sanders and particularly to improvements in pole-type sanders of the type used for joints in dry wall plaster or wallboard and the like.

BACKGROUND ART

Pole-type sanders of the type used for sanding joints in wallboard or dry wall plaster or the like are well known in the art. Such sanders, by way of example, are disclosed in U.S. Pat. Nos. 3,483,662; 2,711,059; 3,123,946 and 2,523,884, and are commercially available from such companies as Hyde Tools, such as its model No. 45390 pole sander. In addition, pole-type sanders have also been employed in connection with floor sanders such as disclosed in U.S. Pat. No. 1,501,192. These prior art pole-type sanders have all employed some type of universal joint in order to permit the flat sandpaper surface, which is generally secured to a flat backing surface, to parallel the wall or ceiling or floor surface against which the sandpaper is applied during the sanding operation. In utilizing these pole-type sanders, the user is generally a considerable distance away from this surface at the other end of the pole or broom handle through which the pressure is applied to the sandpaper surface against the surface or joint being sanded. These prior art pole-type sanders although satisfactory in many instances, have several undesirable features which affect their function. Thus, although it is well known that optimum pressure can be applied against the surface being sanded if the handle or pole can be as low or horizontal as possible in reaching for corners, the structure of the universal joint in conjunction with the sandpaper retention means has prevented this, acting as an impediment rather than an aid in achieving this objective. In addition, the prior art universal joints employed do not generally employ positive friction so that sure control of movement of the sanding surface is lost. Moreover, these prior art pole-type sanders are generally costly to manufacture, employing several components, such as by way of example, fourteen separate components in the aforementioned Hyde Tools pole sander, and require a relatively long time of assembly during the manufacturing process. In addition, although the use of wire clips to retain sandpaper on a sanding block is well known in connection with hand type sanders, such as disclosed in U.S. Pat. Nos. 734,954; 1,415,171 and 2,201,645, they have not generally been employed in the same manner. The previous art hand sanders retained the sandpaper by the friction of the wire clip against the abrasive surface of the sandpaper, thereby providing a not too secure clamping arrangement. These disadvantages of the prior art have been overcome by the present invention which employs, among other things, peripheral contoured guide ramps adjacent to substantially orthogonally disposed slots for a universally movable handle which permit planar disposal of the handle, and a locking spring action clip which provides positive locking and unlocking arrangement to retain sandpaper. This provides the lowest possible profile so that an extremely acute universal joint angle may be obtained when needed. This angle is considerably lower than any others now on the market.

SUMMARY OF THE INVENTION

The present invention comprises a molded pole-type sandpapering tool comprising a molded body member having a flat backing surface for the sandpaper and a handle mounting surface on the opposite side thereof which includes a two-piece resilient molded universal joint to which a molded handle mount is attached and two pairs of spaced apart peripherally disposed molded contoured guide ramps adjacent opposite side of the universal joint and defining a pair of substantially orthogonally disposed slots for the universally mounted handle for enabling planar positioning thereof for applying optimum positive pressure to the abrasive surface. The contoured guide ramps comprise sloped contoured surfaces which positively guide the handle on a contoured path between the orthogonal slots during universal movement of the handle substantially in the plane of the abrasive surface while maintaining optimum pressure. A pair of resilient wire spring clips are pivotally mounted to the guide ramps for removably securing the ends of the sandpaper to the body member to hold the sandpaper against the backing surface. The contoured guide ramps have retention notches therein for removably locking the spring clips in a sandpaper securing position against the handle mounting surface.

BEST MODE FOR CARRYING OUT THE INVENTION

Figures 1, 2, 3:
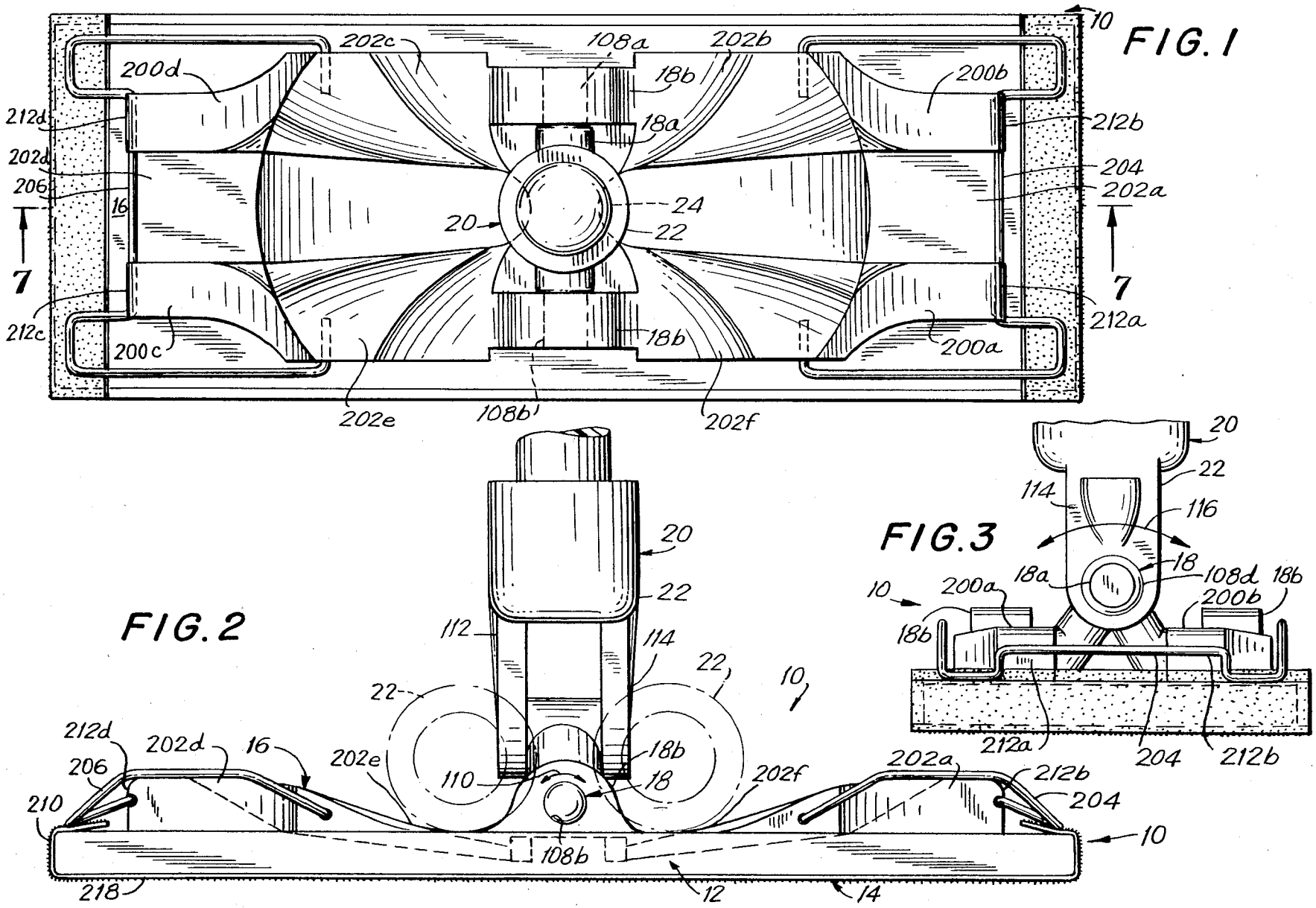
FIG. 1 is a top plan view of the presently preferred embodiment of the present invention.
FIG. 2 is a side elevational view of the embodiment of FIG. 1, taken from either side thereof.
FIG. 3 is an end elevational view of the embodiment of FIG. 1, taken from either end thereof.

Referring now to the drawings in detail, and initially to FIG. 1 thereof, a top plan view of the presently preferred embodiment of the pole-type sandpapering tool or pole sander of the present invention, generally referred to by the reference numeral 10, is shown. Preferably pole sander 10 includes a molded body member portion 12 which is preferably molded from a plastic such as foam polypropylene, to form the various portions thereof. As shown and preferred in FIGS. 1 and 2, body portion 12 preferably comprises a backing surface 14 and a handle mounting surface 16 on the opposite side of said backing surface 14. The handle mounting surface 16 preferably contains a universal joint 18 thereon for universally mounting a pole handle 20 to the body member 12 via a handle mounting socket 22 having internal threads 24 therein which are preferably threadably engageable with the threads disposed on the end of a standard broom type handle 20.

Figure 5:
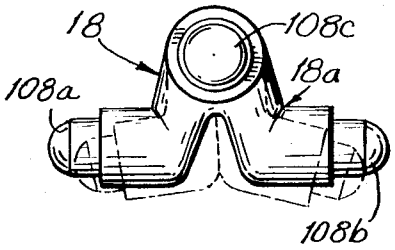
FIG. 5 is a front elevational view of the male clevis portion of the preferred universal joint portion of the embodiment of FIG. 1.
Figure 6:
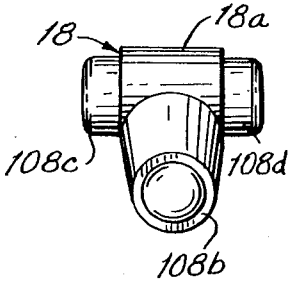
FIG. 6 is a side elevational view of the male clevis portion of FIG. 5.
Figure 4:
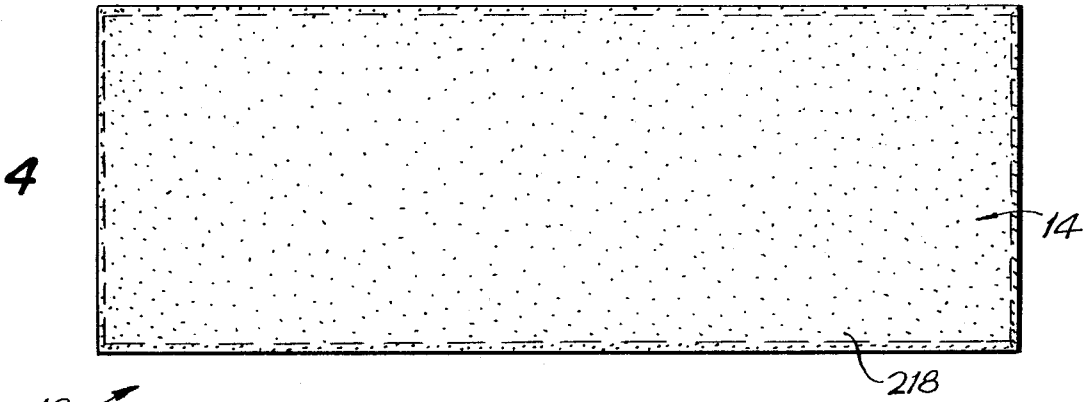
FIG. 4 is a bottom plan view of the embodiment of FIG. 1.
Figure 7:
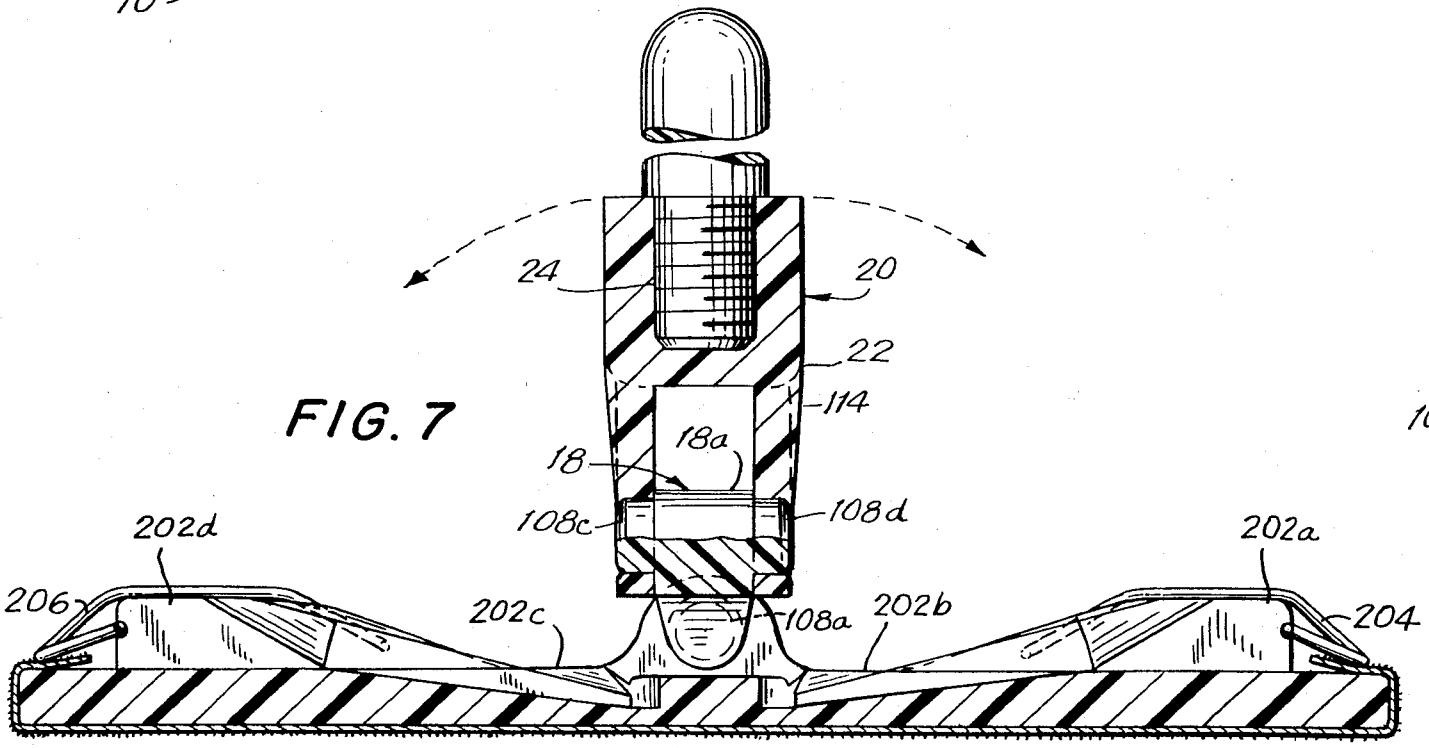
FIG. 7 is a cross-sectional view of the embodiment of FIG. 1 taken along line 7—7 in FIG. 1.

The universal joint 18 preferably comprises a two-piece molded resilient universal joint formed from the same material as the body member 12 for providing a positive friction engagement for the joint 18. This positive friction engagement is achieved by the resilient mounting of a bifurcated male clevis portion 18*a* (FIG. 5) in a pair of spaced apart arcuate female clevis portions 18*b* extending upwardly from handle mounting surface 16. As shown and preferred in FIGS. 5 and 6, as well as FIGS. 1–3, the male clevis portion 18*a* comprises a pair of integrally molded pins 108*a* and 108*b* (FIG. 5) disposed at the respective ends of the bifurcated portion 18*a* and another pair of integrally molded pins 108*c* and 108*d* (FIG. 6) disposed at the apex of the bifurcated portion 18*a*. As shown in FIG. 6, the bifurcated portion 18*a* may be resiliently squeezed together prior to insertion in the corresponding aperture in the spaced apart female clevis portions 18*b*, with the pins 108*a* and 108*b* then being resiliently biased into a rest position in these apertures creating the aforementioned positive frictional engagement with the pins 108*a* and 108*b* being rotatable in the directions of arrow 110 (FIG. 2) about the axis through the pins 108*a* and 108*b*. This provides the end to end rotation of the broom handle 20 in socket 22. With respect to the mounting of pins 108*c* and 108*d*, the socket 22, as shown and preferred in FIGS. 2 and 3, and which is again preferably molded of the same material as body member 12, includes a pair of spaced apart resilient downwardly extending arms 112 and 114 having apertures therein which may be resiliently spread apart to receive pins 108*c* and 108*d*, respectively, to thereafter provide a positive frictional engagement when pins 108*c* and 108*d* are at rest in these apertures, with pins 108*c* and 108*d* being rotatable in the directions of arrow 116 (FIG. 3) about the axis through the pins 108*c* and 108*d*. By combining the two axial rotations defined by arrows 110 and 116 the molded universal joint 18 is provided which, as stated above, may be readily assembled without additional separate pins.

In addition to the universal joint 18, which is preferably centrally disposed on the handle mounting surface 16, the handle mounting surface 16 preferably includes a pair of spaced apart peripheral contoured guide ramps 200*a*–200*b* and 200*c*–200*d*, respectively, disposed on opposite sides of the universal joint 18 which define a series of substantially orthogonal slots 202*a*, 202*b*, 202*c*, 202*d*, 202*e* and 202*f*, respectively, for the broom handle socket 22 on the handle mounting surface 16 so as to positively guide socket 22 and, hence, handle 20, into these slots 202*a*–202*f* and into a planar position parallel to the flat backing surface 14 for enabling optimum pressure applied through handle 20 to bear against the mounted sandpaper surface. As shown and preferred in FIGS. 1 and 2, the contoured guide ramps 200*a*–200*b* and 200*c*–200*d* each comprise a series of sloped surfaces defined by the contour of the smallest possible angle with the sanding plane as the socket 22 rotates 360 degrees via universal joint 18 over the guide ramps 200*a*–200*d* to positively guide the socket 22 between the various orthogonal slots 202*a*–202*f*. The various slopes may be empirically defined prior to finally molding body member 12.

In addition to the above, as further shown and preferred in FIGS. 1–3, a pair of contoured wire spring clips 204 an 206, such as spring steel clips, are preferably employed to removably secure the sandpaper 210 to the body member 12 and hold it in place against the backing surface 14. The spring clips 204 and 206 are preferably pivotally mounted to the guide ramps 200*a*–200*d*, with spring clip 204 being pivotally mounted to guide ramps 200*a*–200*b* and with spring clip 206 being pivotally mounted to guide ramps 200*c*–200*d*. Each of the guide ramps 200*a*–200*d* preferably has a retention slot 212*a*–212*d*, respectively, in the front surface thereof for removably locking the resilient spring clips 204, 206 in place in a sandpaper securing position against the handle mounting surface 16. The ends of the unmounted sandpaper 210 preferably extend past the ends of backing surface 14 and are preferably wrapped around these ends and over underneath these clips 204 and 206 which are then resiliently locked in place in the retention slots 212*a*–212*d* to provide positive pressure against the sandpaper 210 without having to first slide over the sandpaper 210 to get into position. In order to release the clips 204, 206, the finger acts as a wedge against mounting surface 16 to force the clips 204 or 206 up. With this arrangement the sandpaper 210 can be locked in place without the clip having to slide over the sandpaper 210. Moreover, the clip may easily be moved out of the way to load the sandpaper 210.

If desired, as further shown and preferred in FIG. 2, a backing pad 218, such as one comprised of rubber, may be provided between backing surface 14 and the sandpaper 210.

By utilizing the present invention, a pole sander having as few as six pieces can readily be assembled together and will enable optimum pressure to be applied against the abrasive surface.

What is claimed is:

1. A molded pole-type sandpapering tool comprising a molded body member, said molded body member comprising a planar flat backing surface capable of being covered with sandpaper for providing an abrasive surface, and a handle mounting surface disposed on the opposite side of said sandpaper backing surface; and a molded universal joint mounted substantially at the center of said handle mounting surface and being connectable to an elongated handle member for permitting said body member abrasive surface to be disposed in a plurality of angular positions with respect to said handle for enabling optimum positive pressure to be applied to said abrasive surface through said handle member, said universal joint comprising a molded resilient male clevis resiliently engagable in a molded female clevis extending from said handle mounting surface for providing a two piece resilient universal joint having a positive friction fit, said tool further comprising a resilient wire-like unitary spring clip disposed on said handle mounting surface adjacent the ends thereof for removably securing said sandpaper on said backing surface, said spring clip having a locking portion and a pressure engaging portion, said sandpaper extending across said backing surface and around said ends onto said handle mounting surface for enabling positive pressure engagement thereof by said spring clip pressure engaging portion, said handle mounting surface comprising two pairs of spaced apart contoured guide ramps, with said pairs being disposed on opposite sides of said universal joint in the same plane, said spring clip being pivotally mounted to said guide ramp, said guide ramp further comprising a retention notch therein for removably locking said resilient wire spring clip locking portion in a sandpaper securing position against said handle mounting surface for maintaining positive pressure of said spring clip pressure engaging portion against said handle mounting surface.

2. A molded pole-type sandpapering tool in accordance with claim 1 further comprising a pair of said resilient wire spring clips disposed on said handle mounting surface adjacent opposite ends thereof for removably securing said sandpaper on said backing surface.

3. A molded pole-type sandpapering tool in accordance with claim 2 wherein each of said spring clips spans between a pair of said contoured guide ramps.

4. A molded pole-type sandpapering tool in accordance with claim 3 wherein said spring clips are comprised of spring steel.

5. A molded pole-type sandpapering tool in accordance with claim 1 wherein said spring clip is comprised of spring steel.

6. A molded pole-type sandpapering tool in accordance with claim 1 wherein said universal joint further comprises a molded handle mounting receptacle therein for threadably mounting said handle member therein.

* * * * *